United States Patent [19]

Olsen

[11] 4,158,934

[45] Jun. 26, 1979

[54] METHOD OF MANUFACTURING WINDOWS AND UNIVERSAL SASH UNITS THEREFOR

[75] Inventor: Allen J. Olsen, Royal Oak, Mich.

[73] Assignee: Weathervane Window, Inc., Brighton, Mich.

[21] Appl. No.: 842,746

[22] Filed: Oct. 17, 1977

[51] Int. Cl.[2] ..... E05D 15/16; E06B 7/00

[52] U.S. Cl. ..... 49/406; 49/458; 49/501

[58] Field of Search ..... 49/501, 404, 406, 425, 49/458; 160/381, 377

[56] References Cited

U.S. PATENT DOCUMENTS

| | | | |
|---|---|---|---|
| 844,301 | 2/1907 | Charroin | 49/406 |
| 1,074,702 | 10/1913 | Eckberg et al. | 49/458 X |
| 1,512,741 | 10/1924 | Barr | 49/458 X |
| 1,569,413 | 1/1926 | Weingaertner | 49/406 |
| 1,750,110 | 3/1930 | Klim et al. | 49/458 X |
| 1,964,332 | 6/1934 | Rembaum | 160/377 X |
| 2,084,776 | 6/1937 | Peremi et al. | 49/458 X |
| 3,153,818 | 10/1964 | Osten, Sr. | 49/458 X |
| 3,324,597 | 6/1967 | Rich | 49/406 |
| 3,411,247 | 11/1968 | Fleming | 49/501 |

FOREIGN PATENT DOCUMENTS

| | | | |
|---|---|---|---|
| 1121794 | 7/1968 | United Kingdom | 49/404 |

*Primary Examiner*—Philip C. Kannan
*Attorney, Agent, or Firm*—Krass & Young

[57] ABSTRACT

A window sash construction is disclosed for wood framed windows in which a particular stile-rail and check rail member configuration is utilized to adapt a given sash to both vertical double hung and horizontal sliding installations, each sash unit being constructed with a common stile and rail sectional configuration such that all stile and rail members may be provided by two sash member types differing only in having two different end configurations and a common check rail shape in oder to assemble the universal sash units. A reversible common check rail configuration is also provided such that the sash units can be oriented in any mating arrangement while obtaining a proper seal. An antijam check rail seal installation is incorporated in one of the check rail surfaces in engagement when the window is closed, including a seal recess configured to allow an outwardly biased seal lip to cam itself back out of the unoccupied seal recess formed in the mating check rail surface in the event the check rails are displaced beyond their normal engaging position sufficiently for the seal to enter the opposing recess position.

14 Claims, 9 Drawing Figures

METHOD OF MANUFACTURING WINDOWS AND UNIVERSAL SASH UNITS THEREFOR

BACKGROUND OF THE INVENTION

1. Field of the Invention

This invention concerns window sash units and more particularly window sash units of a wood mill construction which are adapted to be opened by either vertical or horizontal movement, i.e., either the double hung or slider type window units.

2. Description of the Prior Art

Two basic types of two-sash opening windows are commonly utilized in residential applications, double hung and slider windows. In the double hung installation, the window sashes are mounted within a window frame for vertical sliding movement. The windows are normally equipped with a sash mechanism to balance their weight to enable the windows to be positioned in any desired partially-opened position, typically by means of a block and tackle cord system normally accommodated by channel recesses formed along the lateral outer edges of each of the lower and upper sash units. The bottom rail of the lower sash normally meets with the sloping windowsill whereas the top rail of the upper sash as well as the stiles or side rails are typically received within a horizontal channel, the horizontal channel generally providing a weather stripping on its exterior edge. The overlapping check rail members of each of the upper and lower sashes in the closed position engage each other with a weather stripping arrangement of various types adapted to seal the engaging surfaces.

The horizontal slider or rolling type window installations involve a pair of sash units, one of which is commonly fixed and the other of which is mounted for sliding or rolling movement in a horizontal direction towards the other sash unit, with the bottommost edge of the sash adapted to accommodate a roller mechanism for support of the weight sash and elimination of friction during opening movement.

The end rail of each sash unit is received within a channel similar in configuration to the top and side channels of the double hung installation incorporating a weather stripping. The top rails in the horizontal sliders are also generally received in channels and adapted to engage the weather stripping during the sliding movement thereof, all provided in order to seal the sash units against the infiltration of outside air.

The inside vertical members comprising one side of each of the sashes, also called check rails, move into mating engagement also usually incorporate a weather stripping arrangement for sealing the mating surfaces as they move into engagement.

The differences in installation details of the sash units of the double hung and the horizontal sliding sash units, i.e., in the double hung the use of the block and tackle cord components and the necessity of mating the bottom rail with the sill sloping configuration and in the horizontal rolling type the roller structure mating with the sill has produced a differing sash configuration for each of these types of window and for the individual sash units in each window installation.

It would of course be advantageous if a common sash unit configuration could be adapted to both sash units of double hung and horizontal sliding installations since manufacturing, inventory, administrative and various other overhead expenses entailed with the stocking and manufacturing of a relatively great number of sash configurations could be eliminated.

Furthermore, among the rail and stile members of which the sash units are constructed there has typically been provided a relatively great number of individual members of varying configurations due to this same factor, increasing the costs of marketing window units due to increased manufacturing costs and the expense of stocking and assembling sash unit members of many different configurations. It would be also advantageous if the sash unit construction could be simplified to reduce the number of stile or rail members, as these framing members are termed, to a minimum.

A serious problem has been encountered with some weather stripping configurations arising from the tendency for the weather stripping seal to create a jam condition between the mating check rails in the event that overtravel of one sash unit with respect to the other occurs due to slamming or looseness in the mating units, allowing a weather stripping seal to enter a weather strip recess in the mating check rail which entry creates a jammed condition since the weather strip edge cannot be removed from the recess without disassembly of the sash units.

It would thus be further advantageous to provide such a universal sash unit in which the check rail sealing or weather stripping arrangement is such as to eliminate the incidences of weather stripping jam conditions developing upon overtravel of the sash units.

It is therefore an object of the present invention to provide a sash unit construction which is adapted to both double hung and horizontal sliding installations without modification and to either of the individual sashes in these installations so as to provide a "universal" sash unit.

It is a further object of the present invention to provide a simplified sash construction in which the stile and rail members are reduced to a minimum number of configurations.

It is yet another object of the present invention to provide such a sash construction in which a check rail weather strip arrangement is provided in which overtravel of the respective sash units can be corrected by merely retracting the sash units without the need to free the weather strip or to disassemble the sash units from the window frame.

SUMMARY OF THE INVENTION

These and other objects, which will become apparent upon a reading of the following specification and claims, are accomplished by configuring the external outer recesses of the sash units to accommodate interchangeably either the sash cord components of a double hung installation or a window roller mechanism of a horizontal slider, which by the method according to the invention are so configured to be received within the same recess. In addition, a similarly configured sill adapter assembly is provided which mounts to the window sill to engage with the same recess configuration as the recess configuration mating with the sash cord pulley or the roller mechanism. The outer lateral surfaces are received within a channel-seal assembly for end or top rail portions of the sash units such that the same sash unit may be installed in either vertical double hung or horizontal slider installations.

The individual sash units feature end joint construction such that the stile member and the top and bottom rail members may all be provided by a single stile-rail sectional configuration with two end variations, and a single check rail configuration, reversible so as to be adapted to any installation. This includes an offset check rail seal recess, which provides for an optional double seal installation. The check rail seal configuration as well as the recess is shaped so as to provide a sloping ramp transition surface which engages the check rail seal lip in the event of sash unit overtravel to guide the check rail seal lip out of the opposing recess, and allow repositioning of the sash unit without creating a jamming condition created by the check rail seal.

DETAILED DESCRIPTION

In the following detailed description, certain specific terminology will be utilized for the sake of clarity and a particular embodiment described with the requirements of 35 USC 112, but it is to be understood that the same is not intended to be limiting and should not be so construed, inasmuch as the invention is capable of taking many forms and variations within the scope of the appended claims.

Figure 1:
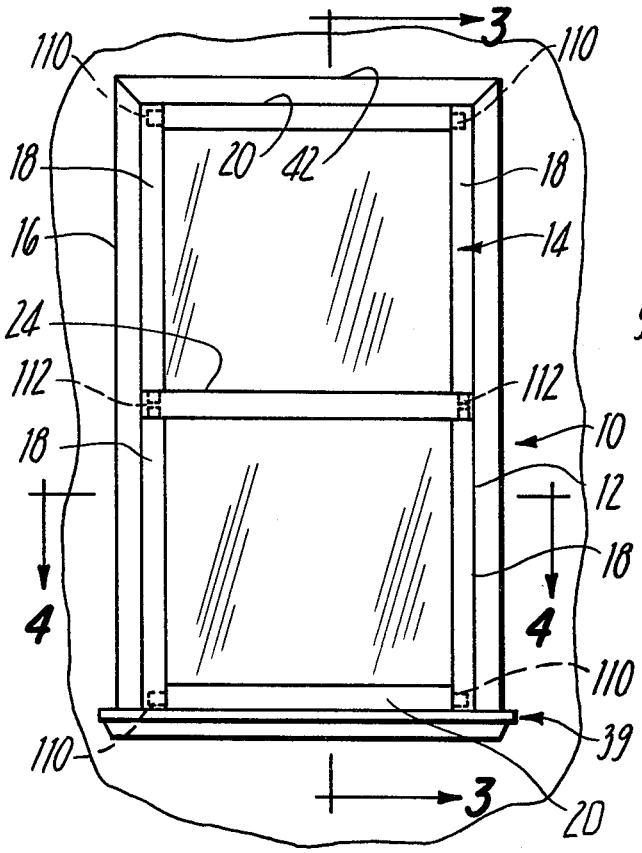
FIG. 1 is an elevational view of a double hung window installation utilizing a universal sash according to the present invention showing in simplified form the end joint construction required to simplify the stile-rail configuration required for each sash unit.
Figure 2:
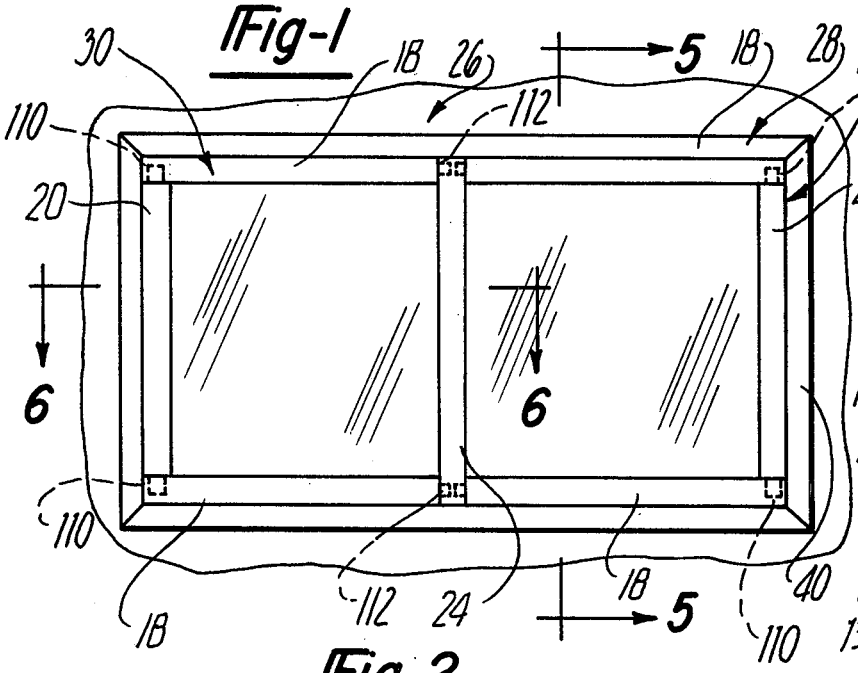
FIG. 2 is an elevational view of a horizontal slider window installation utilizing universal sash units according to the present invention and indicating the end joint construction required for simplification of the sash unit construction.

Referring to the drawings, and particularly FIGS. 1 and 2, the present invention as described above is concerned with providing a universal sash unit for application to both vertically sliding double hung windows as well as horizontal rolling or sliding windows of woodmill construction and for either of the sash units in each installation.

The double hung type windows 10 include a lower sash unit 12 and an upper sash unit 14 vertically slidable within window frame 16. Such windows normally include a block and tackle counterweighting arrangement involving the lengths of sash cord and other components disposed in recesses along the lateral edges of the sash units as will be described hereinafter. The lower and upper sash units 12 and 14 include a pair of stiles 18, within which the recesses are formed to accommodate the sash cord. Included in the sash unit 14 is a top rail 20, as is also included in the bottom sash 12. The overlapping sash members are comprised of check rails 24 which are beveled to provide a mating engagement between the sash units when the window is closed.

The horizontal slider or rolling type window 26, shown in FIG. 2, is similarly constructed with a right hand sash unit 28 and a left hand sash unit 30, with one of the sash units here shown as the right hand sash 28 typically being mounted for movement and the other sash unit being fixed, here shown as the left hand sash unit 30. The direction of movement, of course, in the horizontal slider configuration being in a horizontal direction within the window frame 32.

Each of the right and left hand sash units 28 and 30, respectively, include in similar fashion to the double hung units stile member 18 forming the top and bottom of each sash unit 28 and 30, and rails forming the end of each sash unit 28 and 30 remote from the other sash unit and a pair of check rails 24 which are adapted to move into mating engagement with each other upon closure of the sash unit 28. In the horizontal slider type unit 26, these movable sash units are generally supported by means of rollers which engage a recess in the lower stiles 18, with sealing recesses engaging the periphery of the window to guide and seal the edge of the units in the window frame 32.

From this description, it can be understood that the difference in construction in the double hung and horizontal slider can be found in the basic re-orientation of the units, i.e., the double hung windows are disposed vertically while the horizontal sliders are disposed in horizontal alignment with each other and also in that the mating engagement of the sash units within the window frame 32 differs. That is, the stiles 18 of the double hung unit must accommodate the sash cord mechanism operating parts, whereas the stiles 18 of the horizontal slider must accommodate the roller mechanism. In addition, the end rails of the bottom rails 20 of the double hung window abuts the windowsill 39 of the window frame 16 whereas the end rail 20 of the horizontal slider abuts the side frame 40 of the window frame 32. These members of each of the sash units are equivalent, such difference in mating relationship of the window frame must be accommodated.

In addition, the individual sash units 12 and 14 within each double hung window 10 differs in that the top rail 20 of the upper sash unit 14 and the bottom rail 20 of the lower sash unit 12 mate with the top member 42 of the window frame 16 and the windowsill 39, respectively. Since the windowsill 39 typically presents an inclined surface, the configuration of the rails 20 have conventionally been of a different outer contour such as to accommodate the sloping upper surface of the windowsill 39.

The individual check rails 24 normally incorporated in both the double hung windows 10 and the horizontal slider windows 26 have commonly differed from one another in that the sealing arrangement would incorporate a seal on one of the members adapted to mate with the seal on the other member such that one check rail woul be configured to accommodate a seal while the other would not. Alternatively, a mating seal arrangement might be provided. In either approach, the check rail configurations are different.

According to the concept of the present invention, a universal sash is provided which is interchangeable within the double hung window units 10, i.e., the lower and upper sash units of identical configuration and further that these sash units are also adapted to be directly used without modification in a horizontal slider installation for either the right or left hand sash units. In general terms, this concept is achieved by utilizing a sash cord block and tackle component and slider window roller unit which are configured to be received within identically sized and shaped recesses within the sash units. In addition, the sill engaging the adapter seal structure is installed on the window sills in the double hung units configured to provide a mating engagement with this same recess configuration which accommodates interchangeably the sash cord block and tackle structure and the slider window roller mechanism. Finally, a check rail seal configuration is utilized which can be installed in either the upper or lower sash unit in the double hung installations or the right or left hand sash units in the horizontal slider installations. With these steps, it thus becomes possible to utilize the double hung sash units by merely installing them in the horizontal mode, the side stiles 18 of the double hung units being thus configured to receive the roller mechanism of the stiles 18 in the horizontal slider installation without change. The top rail 20 of the upper sash unit 14 may be repositioned by the unit being inverted and is configured to properly seat on the windowsill structure 39 by provision of the installation of the sill adapter seal.

Referring to FIGS. 3 through 9, the construction details of the sash units and their installation shown to the method of construction according to the present invention has been applied. The double hung units 10 are shown in section in FIGS. 3 and 4. It can be seen that the lower sash unit 12 and the upper sash unit 14 are identical in configuration and are merely inverted relative each other. The lower unit bottom rail 20 mates with an extrusion sill adapter arrangement 44 having a step portion 46 which engages the horizontally disposed lower surface of the bottom rail 20 and a windowsill seal adapted to seal the portion of portion 48 mounted to a portion of the extrusion which extends into a recess 50 formed in the outer periphery of the bottom rail. The windowsill adapter seal 44 is mounted to the windowsill 39 by means of legs 52 disposed in the slots formed in the upper surface 54 of the sill as shown.

The check rails 24 are of identical configuration having check rail seal recesses 56 plowed into the lateral sloping side surfaces 58 of each of the check rails 24. The check rail seal 57 can thus be inserted in either recess 56 or in both, although typically the single seal 57 would suffice, disposed on the weather side of the sash units.

Figures 3, 4, 5, 6:
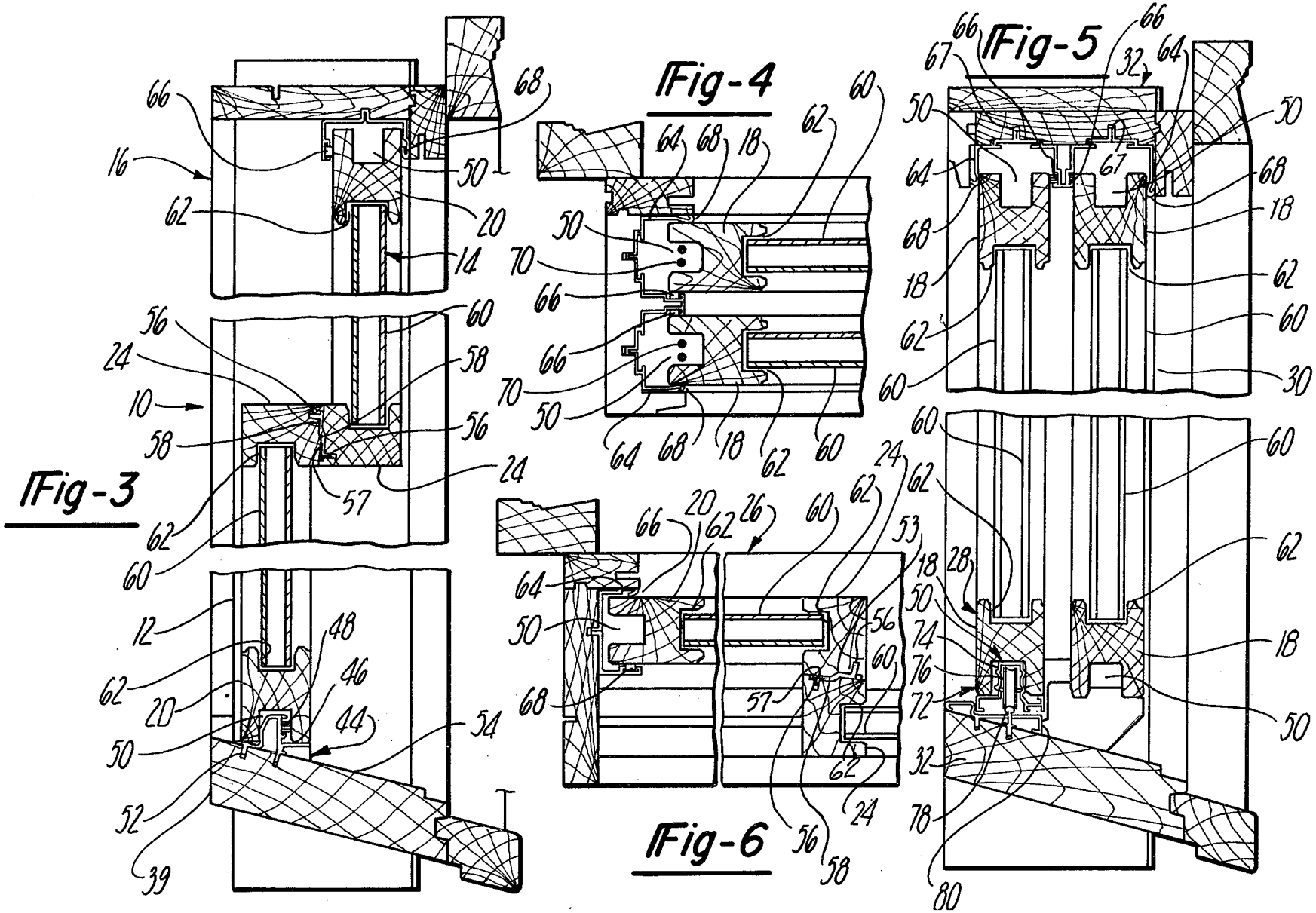
FIG. 3 is a view of the section 3—3 taken in FIG. 1.
FIG. 4 is a partial view of the section 4—4 taken in FIG. 1.
FIG. 5 is a view of section 5—5 taken in FIG. 2.
FIG. 6 is a partial view of section 6—6 taken in FIG. 2.

The glass panels, here shown as insulated glass panels 60, are received within recesses 62 which are of identical configuration in the check rails 24, the bottom rails 20, the top rail 20 and the stiles 18 (see FIG. 4).

The outer edges of the top rail 20 and of the stiles 18 are adapted to mate with channel extrusions 64 which are of identical configuration, including a seal 66 on one side and a tang 68 on the other providing a light frictional engagement therewith to provide a free but firm sliding engagement within the window frame 16.

In the same recess configuration 50 provided for the windowsill adapter seal 44, the bottom rail 20 of the movable sash unit here shown as the right hand sash unit 28, receives the roller assemblies 72. Each roller assembly 72 includes a roller cap 74 within which is rotatably mounted a roller 76 which mates with a track 76 formed on a track extrusion mounted to the windowsill 32. The dimensioning of the outer envelope of the sill adapter seal 44 and the envelope defined by the portions of the roller assembly 72 received within the bottom rail 20 are selected to be of identical sizing such that the recess 50 formed in the bottom rail 20 is of the same size and configuration as the recess 50 formed in each of the bottom rails, top rail and stiles of the double hung units 10.

The stationary sash 30 has a similar recess 50 as the bottom rail 20, although the recess 50 does not perform a function in this installation.

The outer edges of the sash units 28 and 30, stiles 18 are received within similar channel seal units 64 as in the double hung installation adapted to frictionally engage the outer peripheral edges of the stiles 18 of the sash units 28 and 30, including lip portions 68 and seal units 66. The channel seal units 64 are mounted in recesses 67 formed in the window frame 32.

Glass panels 60 are similarly provided within interior recesses 62 formed in the stile members of the top and bottom, left and right hand members 34 and 36, respectively. The check rails 24 are similarly identical in configuration to each other and also to the check rails 24 of the double hung installation with seal recesses 56 formed in both check rails 24 with a check rail seal 57 provided in one of the recesses 56 formed into the mating surfaces 58. It can thus be seen that not only are the right and left hand units of the horizontal unit 26 horizontal, as well as the upper and lower sash units 10 and 12 of the double hung unit 10 identical, but that these are also identical to each other with the top rail members 20 of a double hung window 10 acting as the end rails 20 of the horizontal slider window 26. The stiles 18 of the double hung window 10 form the upper and lower stiles in the horizontal slider and the check rails 24 identical to the check rails 24 such that for a given size unit, a sash configuration that is common to all may be utilized.

Figure 7:
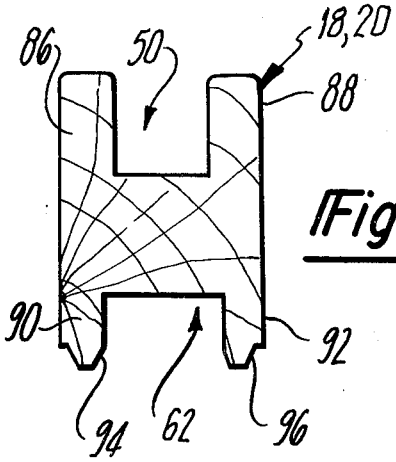
FIG. 7 is a sectional view of a stile-rail member showing the cross sectional configuration thereof.
Figure 8:
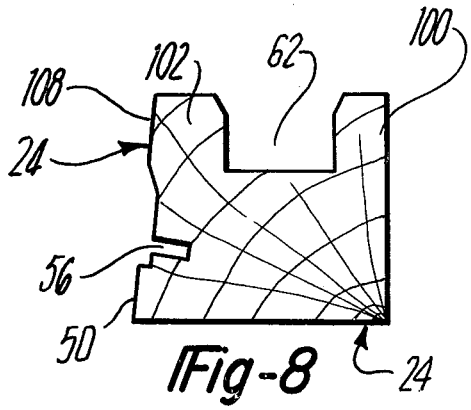
FIG. 8 is a cross sectional view of a check rail incorporated in the universal sash unit.

Examination of FIGS. 3 through 6 will further reveal that there are only two basically different cross sectional mill shapes involved in providing the stiles and rails and check rails of both the horizontal and double hung windows. These are shown in FIGS. 7 and 8, that is, the rails 20 and stiles 18 of both units have an identical configuration as shown in FIG. 7. This includes an H-shaped section as shown in FIG. 7 with recess 50 and channel 62 received into opposing lateral edges of the section 80 to form a pair of parallel side walls 86 and 88 on either side of recess 50 and 90 and 92 on either side of recess 62. The channels 62 which are adapted to accommodate the glass panels 60 are formed with appropriate glazing outer edges 94 and 96 of side walls 90 and 92.

Similarly, the check rails 24 cross section shapes are all identical with a channel 62 formed into a lateral surface thereof to form a pair of side walls 100 and 102 with a sloping or biased surface 58 having formed in it a seal recess 56. Upon reversal of the check rails 24, the sloping lateral surfaces 58 would mate. The seal recesses 56 are formed offset from the center of the surface 58, and thus assume opposite location on either side of the center thereof such that the seal 57 disposed therein may mate with the planar portion 108 of the surface 58 to provide the sealing engagement therewith.

Since the rails 20, stiles 18 and check rails 24 by good design and construction practice are joined by means of mortise and tenon joints, the only variation between the rail 20 and stile 18 members is in the end shapes forming the mating portions. Thus, the cross sectional shape may be shaped into pieces of long length, sections sawed from the lengths and the appropriate end configuration machined thereon.

These end configurations are advantageously related as indicated in simplified form in FIG. 1. That is, the top rail 20 and the bottom rail 20 would both be formed with the tenons 110 passing into appropriate mortises in the stiles 18. Similarly, the stiles 18 have the tenons 112 formed thereon mating with the mortises formed in the respective check rails 24. The bottom rail 22 is also formed with tenons 110, similarly mating with the mortises formed in the stiles 18.

It is, of course, important that the check rails 24 be not formed with alternate end configuration since the check rail must be reversible right and left in all situations. For this reason, they are formed with the mortises at both ends. The stiles 18, on the other hand, can be reversed right to left by inversion of the stiles since the lateral surfaces may be reoriented. That is, the stiles 18 having different end configurations they can still be utilized in both the upper and lower sash units 12 and 14 whereas the check rails 24 cannot have different end configurations and still have a proper mating relationship in all situations.

Accordingly, by this arrangement it can be seen that by use of the section shown in FIG. 7 and two different end configurations, i.e., one with a mortise formed on one end and a tenon on the other and a second with two tenons formed with a tenon formed at both ends, and a check rail having both ends formed with the mortise joint, the universal sash unit construction will be provided which utilizes the upper and lower sash units 12 and 14 of double hung windows 10 and the right and left hand of horizontal slider window units 26 can be provided such that for each size sash only three different sash frame members are required.

Figure 9:
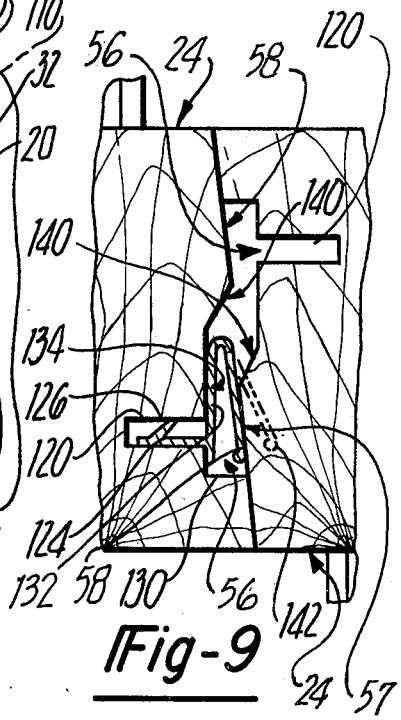
FIG. 9 is an enlarged sectional view through a pair of mating check rails of a configuration according to the present invention showing the details of the check rail seal and the seal recess.

Considering the check rail seal arrangement which is shown in enlarged section in FIG. 9, if it is proposed as here to use a commonly configured check rail 24 for both mating check rails 24 and a sealing arrangement is used in which a seal is carried by one check rail 24 which meets with the surface 108 on the other, the seal cannot be located centrally if a seal receiving recess is plowed into a sloping mating surface of the check rails. This is so since the seal would of necessity be aligned with the empty recess plowed into the surface of the opposing check rail 24. Thus, the seal must be located offset with respect to the center of the mating surfaces such that the seal may engage an unmachined mating surface portion of the check rails. The offset thereby provides the planar seal engaging surface.

On the other hand, if this is done, problems may arise upon overtravel of the sash units with respect to each other. Typically, the sealing arrangement involves a lip-type seal which is resiliently deformed by engagement with the mating surface and has an inherent tendency to spring back outwardly. If only a single such seal is used, as would be usual, the unoccupied seal recess in the opposing check rail allows spring back of the seal upon relative movement of the one sash unit sufficiently such that the lip of the check rail seal can move outwardly into the unoccupied recess. Upon return movement of the sash unit, the seal would have a tendency to jam or wedge itself between the recess and the seal carrying check rail surface such that a jammed condition would likely be created which would be extremely difficult to alleviate and might require removal of the sash units from the window frame.

Accordingly, according to the present invention, the universal sash units are adapted to be provided with check rail seal means of a type which allows sliding movement over each other in either direction freely without development of a jammed condition such that the truly universal sash in which identical check rail configurations are utilized become feasible. This means is provided according to the embodiment disclosed in the present application by the arrangement shown in FIG. 9. Such check rail seals normally include a seal retaining recess 56 extending into the surface 58 of the check rail 24 which slopes to provide a mating engagement with the opposing check rail as shown. The check rail seal 57 is formed from a plastic or rubber seal material and includes a tail portion 124 having a retaining lip 126 integral therewith disposed in the recess 120 so as to be frictionally retained therein. The check rail seal 122 includes a folded lip section 130 including a portion 132 which is adapted to lie flat within a seal receiving pocket 134 against the bottom thereof and includes an upper sealing leg 136 which is formed to tend to assume the position shown in phantom in FIG. 9, but which upon engagement with the opposing surface 58 of the check rails 24, lies flat against the surface 104 to provide the sealing pressure engagement therewith. The seal recesses indicated at 56 as a whole are offset from the surfaces 108 such that upon mating engagement of the respective check rails 24, the recesses 56 are disposed opposite a planar portion 108 to provide a sealing relationship between the abutting check rails 24.

According to the arrangement of the present invention, the seal recesses 56 are provided with overlapping transition sections 140 which are sloping at an oblique angle with respect to the mating surface 108 such that upon overtravel of the respective check rail units 24 in the direction indicated by the arrows in the FIG. 9, the leading bead edge 142 of the upper leg 123 will engage the surfaces 140 and cam or ramp themselves back into the flattened position shown in FIG. 9.

Accordingly, the check rails 24 are movable relative each other by means of the seal 57 with the sealing engagement in either direction within limits to solve the above described problem. If the weather conditions and fit of the windows warrants it, a seal may be provided in both of the seal recesses 56, in which case the respective seals 57 simply wipe over one another. The transition surfaces 140 insure that no catching of the beads 142 would be produced during attempted repositioning of the sash units in proper relationship.

Accordingly, it can be appreciated that a universal sash unit has been provided for wood milled window construction adapted for both double hung and horizontal slider installations which sash units are interchangeable within the respective double hung and horizontal slider installations, i.e, the upper and lower sash are of identical configuration as is the right and left in a horizontal slider. Furthermore, the universal sash construction is of an extremely simplified construction itself involving only two milled cross sectional shapes with a maximum of three configurations to further simplify the manufacturing of these sash units. The seal arrangement, while providing effective check rail seal, insures that a common check rail configuration can be used without creation of a jam condition upon an overtravel of the sash units during movement of the sash units to thus achieve the objects of the present invention.

The embodiments of the invention in which an exclusive property or privilege is claimed are defined as follows:

1. A double hung window using interchangeable top and bottom sash units comprising:

a window frame including a sloping sill surface extending across the bottom of said window frame;

a windowsill adapter secured to said windowsill;

a pair of interchangeable sash units, each sash unit comprising a pair of stile members and a check rail member joining said member to one of their ends thereof and a rail member joining the other end of said stile members;

said sash unit mounting a window panel therein;

means mounting said sash unit in said window frame for sliding movement therein parallel to each other to a closed position with said check rails in overlapping relationship, both of said check rail members being formed with sloping surfaces adapted to mate with each other upon movement of said sash units to the closed position, wherein said sash units occupy said window frame and wherein both of said rail members are configured with an external recess formed in said outer lateral surface thereof adapted to mate and receive said windowsill adapter whereby either of said rail members may be utilized to either said rail members of said upper or lower sash units and installed so as to engage said sill adapter unit, whereby said upper and lower units are interchangeable;

said double hung window further including check rail seal means installed on at least one of said check rails and adapted to engage the other of said check rails and provide a check rail seal upon movement of said sash units into the closed position with said check rail member surfaces in mating relationship;

said sealing arrangement providing a free movement of said at least one check rail seal over the opposite surface of the mating surface of the opposite check rail member past said mating relationship and in a reverse direction whereby in the event of overtravel of said sash unit past the closed position, jamming between said check rail members created by said sealing arrangement is eliminated.

2. The double hung window according to claim 1 wherein said sash units are of wood construction.

3. The double hung window according to claim 2 wherein said stile members, rail members and check rails are secured togehter fabricated with mortise and tenon joints and wherein said check rail members are formed at both ends with similar mortise or tenon joint end configurations, wherein said stile members are formed with alternate end configurations and said rail member is formed with the opposite mortise/tenon joint configurations to said check rail members whereby a single check rail configuration may be utilized in said sash units and wherein said rail and stile members differ only in end joint configuration and said stile members are identical on either side of said sash units by being installed in reverse orientation on either side of said sash units.

4. A check rail sealing arrangement for windows of the type including a pair of sash units slidably mounted within a window frame and having check rail members formed with sloping mating surfaces adapted to move into engagement upon positioning of said sash unit in a closed position, said sealing arrangement including:

a seal recess formed into each of said check rail means;

said recesses positioned offset from the other whereby said check rail surfaces are reversible and further including a sealing member mounted within at least one of said seal recesses, said sealing member including:

a deflectable sealing element adapted to engage the mating surface of the other of said check rail members, the improvement comprising:

a recess transition surface formed in each of said seal recesses and adapted to engage said deflectable element of said sealing means upon overtravel of said sash units and said window frame sufficiently for said sealing arrangement to pass into said sealing recess and guide said deflectable sealing element out of said other seal recess upon return movement of said sash unit in said window frame from said overtravel position.

5. The check rail sealing arrangement according to claim 4 wherein said sealing element includes a deflectable element of said sealing arrangement comprising a reversely bent lip seal.

6. The sealing arrangement according to claim 4, wherein said transition surface comprise a sloping ramp formed on said surface at an oblique angle to said surface and extending downwardly into said sealing recess.

7. A method of manufacturing two-sash, opening windows utilizing universal sash units adapted to be interchangeable in either sash units including the steps of;

fabricating universal sash units each having a pair of stile members joined to each other at one of their ends by a rail member and at the other of their ends by a check rail member, enclosing a window panel, said check rail member having a surface configured to provide a mating engagement with a surface of a reversely disposed check rail of another universal sash unit, said manufacturing step further including forming said stiles and rail member with an external recess formed along the outer lateral surface thereof of the same configuration in both the stile and rail members;

fabricating window frames having operating components configured to be received within the external recess of either the stile or rail members of each unit;

assembling said universal sash units in said window frames in pairs, with the check rail reversely oriented to be in mating engagement when said sash units are in the closed position;

installing check rail sealing arrangement in the mating faces of said check rail, said sealing arrangement allowing free movement of said mating surfaces in either direction past each other to prevent jamming created by overtravel of said sash units;

whereby said universal sash units may be installed interchangeably in either sash unit of the windows.

8. The method according to claim 1 wherein said windows are horizontal slider windows and wherein said method includes the step of manufacturing horizontal slider installations including sash unit roller operating componets mounted within said rail stile and also configured to be mounted within said stile recesses.

9. The method according to claim 7, wherein said windows are double hung windows and wherein said method includes the step of manufacturing double hung window installations including block and tackle operating components adapted to be received within said stile recesses.

10. The method according to claim 1 wherein in said fabricating of said sash units, said stiles, rails and check rails are milled from wood.

11. The method according to claim 10 wherein said stile members, rail members and check rails are secured together in said step of fabricating sash units by milling the ends thereof with mortise and tenon joints and wherein said check rail members are formed at both ends with similar mortise or tenon joint end configurations wherein said stile members are formed with alternate end configurations and said rail member is formed with the opposite mortise/tenon joint configuration to said check rail members whereby a single check rail configuration may be utilized in fabricating said sash units and wherein said rail and stile members differ only in end joint configuration and said stile members are identical on either side of said sash units by being installed in reverse orientation on either side of said sash units.

12. The method according to claim 1 wherein in installing said check rail sealing arrangement, the seal recess is formed in said mating surfaces of each of said check rails of said universal slider unit, each of said recesses being offset from the center line of said mating face.

13. The method according to claim 12 wherein a weather strip seal is mounted in said sealing recess in said step of providing a check rail sealing arrangement in said check rails.

14. The method according to claim 13, wherein said check rail seal includes a wiper seal member having a lip portion thereof installed to be deflected by engagement of said mating surfaces in a reverse direction to the relative movement of said sash units and moving to the closed position and wherein said recesses are formed with transition sloping ramp surfaces extending toward the center of said mating surfaces, whereby said lip portion may be guided back into deflected condition upon reverse movement of said sash unit if said sash unit overtravels with respect to each other past the position wherein said sash units are in the closed position.

* * * * *

UNITED STATES PATENT AND TRADEMARK OFFICE

CERTIFICATE OF CORRECTION

PATENT NO. : 4,158,934

DATED : June 26, 1979

INVENTOR(S) : Allen J. Olsen

It is certified that error appears in the above—identified patent and that said Letters Patent is hereby corrected as shown below:

In the Abstract, line 10, "oder" should read -- order --.

Column 9, Claim 1, line 11, after "said" insert -- stile --.

Signed and Sealed this

Twenty-second Day of January 1980

[SEAL]

Attest:

SIDNEY A. DIAMOND

Attesting Officer

Commissioner of Patents and Trademarks

UNITED STATES PATENT AND TRADEMARK OFFICE

CERTIFICATE OF CORRECTION

PATENT NO. : 4,158,934

DATED : June 26, 1979

INVENTOR(S) : Allen J. Olsen

It is certified that error appears in the above-identified patent and that said Letters Patent are hereby corrected as shown below:

In the Abstract, line 10, delete "oder" and insert --order--;

Column 3, line 66, after "the" (2nd occurrence) insert --top--;
line 66, after "a" delete --top--;

Column 9, Claim 1, line 11, after "said" insert --stile--.

THIS CERTIFICATE SUPERSEDES CERTIFICATE OF CORRECTION ISSUED January 22, 1980.

Signed and Sealed this

*Twenty-second* Day of *April 1980*

[SEAL]

*Attest:*

SIDNEY A. DIAMOND

*Attesting Officer*

*Commissioner of Patents and Trademarks*